United States Patent [19]

Lenmark, Sr. et al.

[11] Patent Number: 5,040,678

[45] Date of Patent: Aug. 20, 1991

[54] BIOLOGICAL SAMPLE TRANSPORT CONTAINER

[75] Inventors: Voigt O. Lenmark, Sr., St. Louis Park; William A. Koentopp, St. Paul, both of Minn.

[73] Assignee: Transpan Company, Minneapolis, Minn.

[21] Appl. No.: 534,752

[22] Filed: Jun. 7, 1990

[51] Int. Cl.[5] ..... B65D 85/20

[52] U.S. Cl. ..... 206/443; 206/204; 206/459; 206/523; 206/570; 62/457.7

[58] Field of Search ..... 206/204, 372, 373, 438, 206/443, 459, 523, 524, 570, 571; 62/457.7, 457.9, 459

[56] References Cited

U.S. PATENT DOCUMENTS

| | | | |
|---|---|---|---|
| 3,435,946 | 4/1969 | Sobek et al. | 206/46 |
| 3,596,754 | 8/1971 | Peterson, Jr. | 206/14 |
| 4,024,731 | 5/1977 | Branscum | 62/457.7 |
| 4,049,121 | 9/1977 | White | 206/459 |
| 4,050,264 | 9/1977 | Tanaka | 62/457.7 |
| 4,106,597 | 8/1978 | Shook et al. | 190/42 |
| 4,206,844 | 6/1980 | Thukamoto et al. | 206/459 |
| 4,213,528 | 7/1980 | Kreutz et al. | 206/205 |
| 4,240,547 | 12/1980 | Taylor | 206/204 |
| 4,250,998 | 2/1981 | Taylor | 206/571 |
| 4,319,629 | 3/1982 | Hotta | 62/457.7 |
| 4,375,828 | 3/1983 | Biddison | 150/2.1 |
| 4,388,023 | 8/1987 | McGill et al. | 206/459 |
| 4,501,360 | 2/1985 | Levy et al. | 206/443 |
| 4,569,082 | 2/1986 | Ainsworth et al. | 206/522 |
| 4,573,581 | 3/1986 | Galloway et al. | 206/570 |
| 4,640,418 | 2/1987 | Lowry | 206/499 |
| 4,679,688 | 7/1987 | Sölderhold et al. | 206/204 |
| 4,801,213 | 1/1989 | Frey et al. | 206/522 |
| 4,805,776 | 2/1989 | Namgyal et al. | 206/523 |
| 4,826,003 | 5/1989 | Levy . | |
| 4,852,732 | 8/1989 | Wilski et al. | 206/204 |
| 4,884,684 | 12/1989 | Bernardin et al. | 206/523 |
| 4,932,533 | 6/1990 | Collier | 206/443 |
| 4,955,480 | 9/1990 | Sexton | 206/523 |

*Primary Examiner*—David T. Fidei
*Attorney, Agent, or Firm*—Kinney & Lange

[57] ABSTRACT

A biological sample transport container is provided for transporting vials containing medical or laboratory specimens. The container comprises a hollow encasement portion having a base wall, a pair of side walls and a pair of end walls. A plurality of shock absorbent blocks are furnished having at least one hole extending through at least one block for holding the vials. The blocks rest upon the base wall between the side walls and the end walls. In addition, a cover lid and a guide mechanism for guiding the cover lid over the block of shock absorbent material is provided. The guide mechanism is disposed in the end walls of the encasement cover above the blocks. A jacket having a jacket cover and a jacket body is hingedly connected to the jacket body. The jacket body surrounds the hollow encasement portion whereby a fastening mechanism for releasable securing the closure of the jacket securely restrains the cover lid from being dislodged from the guide means.

17 Claims, 2 Drawing Sheets

BIOLOGICAL SAMPLE TRANSPORT CONTAINER

BACKGROUND OF THE INVENTION

The present invention relates to containers for transporting biological sample vials, and in particular, it relates to containers, each having a plurality of shock absorbent blocks and a cover lid for transporting medical or laboratory biological sample vials.

The use of containers having shock absorbent material for protecting the contents of the container, generally, medical and laboratory vials carrying vials of such items as blood and urine, is well known. For instance, the Great Britain Patent No. 2,173,174 describes a package for vials comprising a block of shock absorbent material with a plurality of bores extending therethrough. A separate piece of shock absorbent material is placed at the bottom of the bores with yet another separate piece of shock absorbent material placed across the bores. A sleeve holds the block and the absorbent material pieces in position.

SUMMARY OF THE INVENTION

A biological sample transport container is provided for transporting vials containing medical or laboratory specimens. The container comprises a hollow encasement portion having a base wall, a pair of side walls and a pair of end walls. Preferably, the hollow encasement portion comprises a thin layer of impact resistant material.

A plurality of rectangular resilient retainer pads having at least one hole extending through at least one pad to hold and secure the vials. The pads rest upon the base wall between the side walls and the end walls. In the preferred embodiment, the plurality of pads comprise a base pad, a middle pad and a top pad. At least one hole extends through the middle pad. In addition, a plurality of apertures extend through the top pad.

A cover lid covers the encasement portion. Like the hollow encasement portion, preferably, the cover lid comprises a thin layer of transparent, impact resistant material.

Preferably, each of the vials is inserted into a transparent secondary sleeve-like container. Each secondary container encloses the respective vial and a packet or plug containing a desiccant having a dye indicator reactive with moisture whereby the desiccant changes to a bright color when exposed to moisture. The secondary container is heat sealed to completely enclose a single vial and a desiccant packet.

Each of the secondary container and its respective vial and desiccant are then inserted into a separate transparent, slightly larger, sleeve-like tertiary container. The tertiary container is heat sealed to completely enclose the respective secondary container and its contents for providing redundant leakproof packages.

A guide mechanism for guiding the cover lid over the encasement portion is provided. The guide mechanism is disposed in the end walls of the encasement cover.

A jacket having a jacket cover and a jacket body is also provided. The jacket cover is hingedly connected to the jacket body. The closed hollow encasement portion is placed into the jacket, the cover is closed and a fastening mechanism securely closes the jacket cover and holds the cover lid of the encasement portion in place. Preferably, the jacket comprises a cloth fabric and the fastening mechanism comprises a zipper.

Preferably, a plurality of cooling packets are provided. The cooling packets may be positioned in each hole of the middle pad and contains a material that has been separately cooled, or which is a cryogenic material, to keep the vials cool during shipment.

A cooling chest encases the jacket. The cooling chests also may be lined with the cooling packets for keeping the vials cool.

DETAILED DESCRIPTION OF THE PREFERRED EMBODIMENTS

Figure 1:
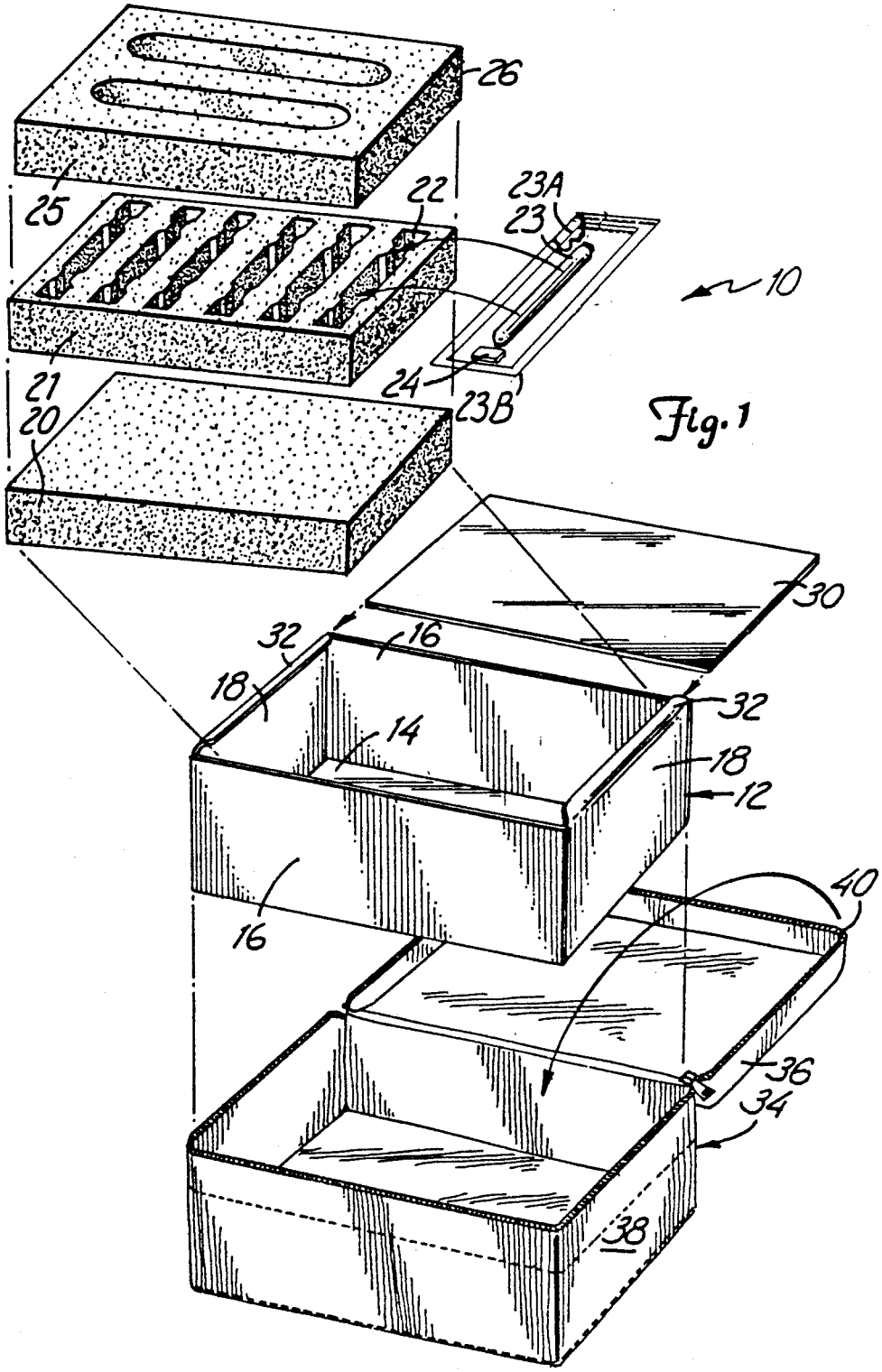
FIG. 1 is an exploded perspective view of the biological sample transport container of the present invention.
Figure 2:
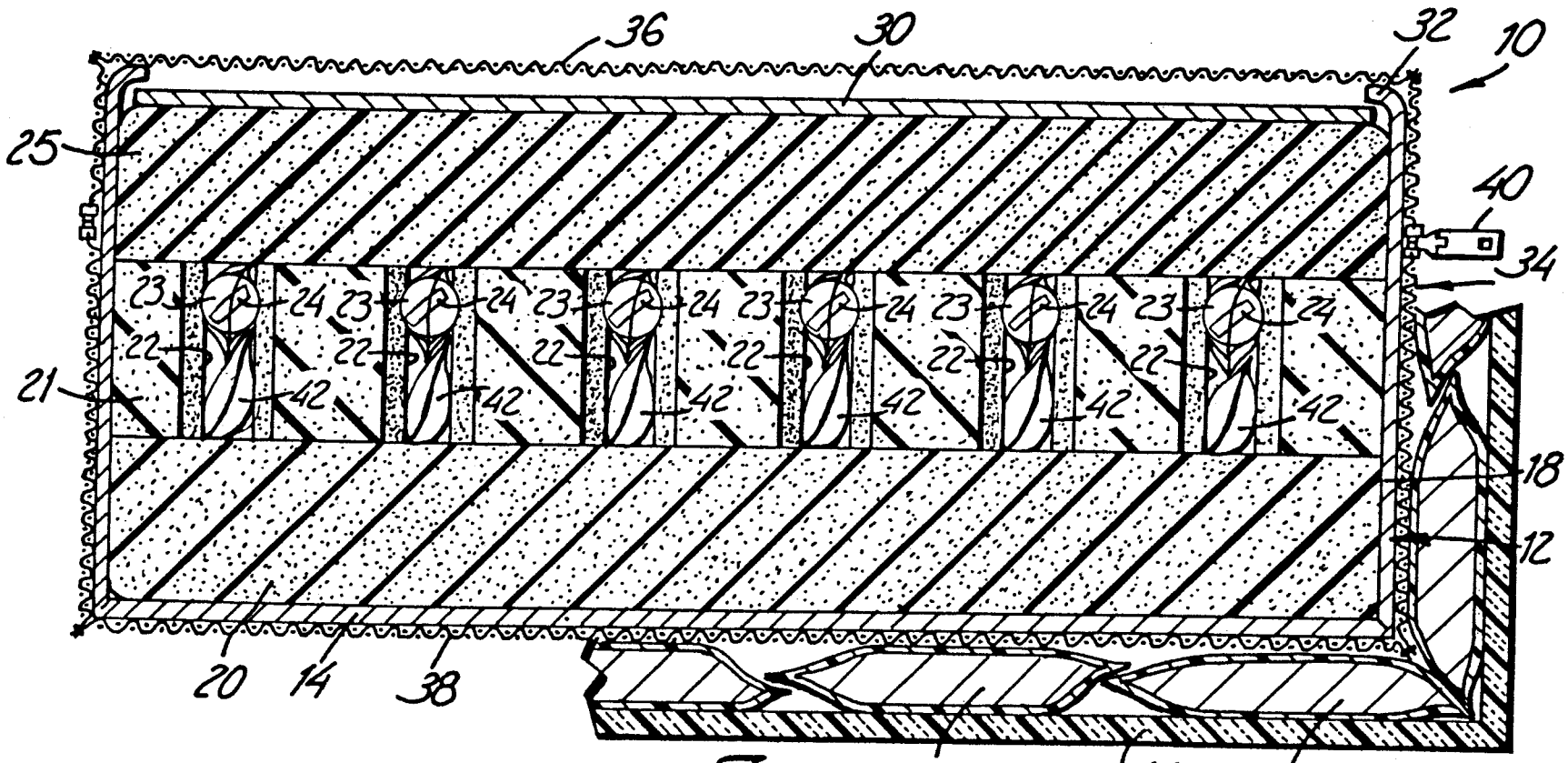
FIG. 2 is a sectional view taken along line 2—2 in FIG. 1.

A biological sample transport container for transporting vials containing medical or laboratory specimens of the present invention is generally indicated at 10 in FIG. 1. The container 10 comprises a hollow encasement portion 12 having a base wall 14, a pair of side walls 16 and a pair of end walls 18.

Preferably, the hollow encasement portion 12 is molded from a plastic material to form a thin layer of impact resistant material. The encasement portion 12 is molded such that the side walls 16 and the end walls 18 are integral with the base wall 14 and integral with each adjacent end wall 18 and each adjacent side wall 16, respectively.

In the preferred embodiment, the encasement portion 12 includes two parallel end walls 18 and two parallel side walls 16 perpendicular to each end wall 18. The end walls 18 and the side walls 16 are preferably substantially perpendicular to the base wall 14. The integral connection between the end walls 18, the side walls 16, and the base wall 14 prevents leakage of any hazardous laboratory or medical samples, which could possibly spill or leak from the vials.

A plurality of rectangular resilient retainer pads 20, 21 and 25 are positioned within the encasement portion 12 the retainer pad 20 rests upon the base wall 14 and fit snugly between the end walls 18 and the side walls 16. The other pads 21 and 25 are stacked on top of pad 20. The pads 20, 21 and 25 comprise pieces of shock absorbent material. The pad 21 has at least one hole 22 (in practice, several are provided) extending therethrough for holding a standard medical or laboratory vial 23. The vials 23 are inserted in the holes 22 of the center pad 21 and are frictionally held therein. Preferably, the vial 23 includes a cap to prevent spillage of the vial contents.

The hole 22 extends through the middle pad 21 only such that the vials 23 are positioned horizontally as best illustrated in FIG. 1. The placement of the top pad 25 above the vials 23 and the base pad 20 beneath the vials 23 gives the vials 23 extra protection against breakage.

In addition to the vial securing holes 22 in the middle pad 21, a plurality of apertures 26 extend through the top pad 25 as best illustrated in FIG. 1. The apertures 26 are aligned with the holes 22 and allow the person receiving the container 10 to view the vials 23, to observe any leakage or spillage, without removing the top pad 25 while maintaining the vials 23 in a secure position during shipment.

Preferably, each of the vials 23 is inserted into a double plastic sleeve outer package. A transparent secondary sleeve-like container 23A is placed over each vial. Each secondary container 23A also contains a desiccant packet or plug 24 having a dye indicator reactive with moisture (the packet wall is not waterproof) whereby the desiccant 24 changes to a bright color when exposed to moisture. By providing the dye indicator, the medical or laboratory technician will be able to ascertain whether the vial 23 in each container has been opened or has leaked before the medical or laboratory technician touches the vial 23. The secondary container 23A is heat sealed in a known fashion to completely enclose the respective vial 23 and the desiccant 24.

A transparent plastic tertiary sleeve-like container 23B is also used for each of the vials 23. Each secondary container 23A and the associated vial 23 and desiccant 24 are inserted into a tertiary container or outer sleeve 23B. The tertiary container 23B is heat sealed to completely enclose the secondary container 23A. The containers 23A and 23B are made leakproof with a double sleeve package and leaks from the vials are contained.

A cover lid 30 for covering the encasement portion 12 rests on the top pad 25. Like the hollow encasement portion 12, preferably, the cover lid 30 is molded from a plastic material to form a thin layer of impact resistant material. In the preferred embodiment, the cover lid 30 is constructed of a transparent plastic material such that a medical technician or laboratory assistant can view the vials and the transparent containers therefor through the cover lid 30 and openings 26 to determine whether any leakage or spillage had occurred before the cover lid 30 is opened. However, use of a cover lid 30, which is translucent or opaque, is also within the scope of this invention. As will be described, the cover lid 30 is securely restrained from sliding off the top pad 25.

A pair of guides 32 guide the cover lid 30 onto the pad 25. The guides 32 preferably are integral with and extend along tops of the end walls 18 and are above the edges of the side walls 16. The cover lid 30 slides along the guides 32 and is frictionally held in place between the guides 32 and the pad 25. The guides 32 curve over the ends of the cover lid 30 to keep it in contact with pad 25. The guides 32 are at least slightly resilient.

A jacket 34 completely encloses the encasement portion 12 and further secures the cover lid 30 in place. The jacket 34 includes a jacket cover 36 and a jacket body 38. The jacket cover 36 is hingedly connected to the jacket body 38. The jacket body 38 surrounds the hollow encasement portion 12 whereby a fastening mechanism 40 for releasably securing the closure of the jacket 34 securely restrains the cover lid 30 from being dislodged from the guides 32. Preferably, the jacket 34 comprises a cloth fabric and the fastening mechanism 40 comprises a zipper. The jacket 34 also may include tear resistant nylon or other material, although any type of material may be used as the jacket 34. In addition, the fastening mechanism 40 also may include, for example, snaps, buttons, hook and loop fasteners or buckles, although any type of fastener may be used as the fastening mechanism 40.

Preferably, a plurality of cooling packets 42 are provided. The cooling packets 42 are positioned in each hole 22 of the middle pad 21 and each packet 42 contains a material which has been separately cooled, such as ice, or a glycol solution, or a cryogenic material whereby the vials 23 rest on the cooling packets 42. The cooling packets 42 maintain the contents of the vials 23 at a lower temperature than the surrounding environment thereby preserving the contents and reducing potential spoilage.

In a preferred embodiment, a cooling chest 44 encases the jacket 34. The cooling chest 44 includes an insulated liner for maintaining the contents of the jacket 34 at a lower temperature than the surrounding environment. The cooling chest 44 is lined with a plurality of cooling packages 46 containing material similar to packets 42 including, if desired, a cryogenic material thereby assisting the cooling packets 42 in keeping the contents of the vials 23 at a lower temperature than the surrounding environment.

Although packets 42 have been described, it should also be noted that the method of cooling the vials 23 include loose cold material, cold granules and cold liquid between the cooling chest 44 and the jacket 34. In addition, the vials 23 could be cooled by means of a refrigerant circulated by way of a compressor or by fans blowing cool air between the cooling chest 44 and the jacket 34. The same material which could be used between the cooling chest 44 and the jacket 34 could also be used within the holes 22 of the middle pad 21.

By providing a biological sample transport container 10 according to the present invention, the cover lid 30 is easily inserted and provides positive and safe coverage of the vials 23 enclosed in the pads 20, 21 and 25. The cover lid 30 resists penetration of any object which could break or damage the vials 23 and, therefore, offers a protected enclosure for the safe shipment and transport of hazardous medical and laboratory samples. The vials 23 are packaged so they can be checked for leaks before opening the outer cover lid to insure safety for operators. Leaks are easily identified by use of a dye containing desiccant material.

Although the present invention has been described with reference to preferred embodiments, workers skilled in the art will recognize that changes may be made in form and detail without departing from the spirit and scope of the invention.

What is claimed is:

1. A biological sample transport container for transporting vials containing medical of laboratory specimens, the container comprising:

a hollow encasement portion having a base wall, a pair of side walls and a pair of end walls;

a plurality of rectangular resilient retainer pads having at least one hole extending through at least one of the pads for holding the vials, the pads resting upon the base wall between the side walls and the end walls;

a cover lid resting on the pads, the cover lid covering the encasement portion;

guide means for guiding the cover lid over the encasement portion wherein the guide means comprise a finger extending from the end walls above the pads, the finger forming a guide slot;

a jacket having a jacket cover and a jacket body, the jacket cover hingedly connected to the jacket body, the jacket body surrounding the hollow encasement portion; and fastening means for releasably securing the closure of the jacket whereby the jacket securely restrains the cover lid from being dislodged from the guide means.

2. The container of claim 1 wherein the hollow encasement portion comprises a thin layer of impact resistant material.

3. The container of claim 1 wherein the cover lid comprises a thin layer of impact resistant material.

4. The container of claim 1 wherein the plurality of rectangular resilient retainer pads comprises three resilient pads having a base pad, a middle pad and a top pad.

5. The container of claim 4 wherein the top pad includes a plurality of apertures extending therethrough.

6. The container of claim 4 wherein at least one hole extends through the middle block.

7. The container of claim 1 wherein each of the vials is inserted into a transparent secondary container, the secondary container containing a desiccant having a dye indicator reactive with moisture whereby the desiccant changes to a bright color when exposed to moisture.

8. The container of claim 7 wherein the secondary container is heat sealed thereby completely enclosing the vial and the desiccant.

9. The container of claim 7 and a transparent tertiary container is positioned over the secondary container and the vials.

10. The container of claim 9 wherein the tertiary container is heat sealed thereby completely enclosing the secondary container.

11. The container of claim 6 and means for cooling the vials.

12. The container of claim 6 wherein the cooling means comprises a plurality of cooling packets, the cooling packets positioned in each hole and containing a cryogenic material whereby the vials rest on the cooling packets.

13. The container of claim 1 and a cooling chest encasing the jacket, the cooling chest having a means for cooling the contents of the jacket.

14. The container of claim 13 wherein the cooling means comprises a plurality of cooling packets containing cryogenic materials, the cooling packets positioned between the cooling chest and the jacket.

15. The container of claim 1 wherein the jacket comprises a cloth fabric.

16. The container of claim 1 wherein the fastening means comprises a zipper.

17. The container of claim 1 wherein the cover lid is constructed of a transparent material.

* * * * *

UNITED STATES PATENT AND TRADEMARK OFFICE

CERTIFICATE OF CORRECTION

PATENT NO. : 5,040,678

DATED : August 20, 1991

INVENTOR(S) : Voigt O. Lenmark, Sr. et al.

It is certified that error appears in the above-identified patent and that said Letters Patent is hereby corrected as shown below:

Col. 4, line 44, delete "of", insert --or--.

Signed and Sealed this

Sixth Day of October, 1992

*Attest:*

DOUGLAS B. COMER

*Attesting Officer*

*Acting Commissioner of Patents and Trademarks*